United States Patent [19]

Hook

[11] Patent Number: 4,526,512

[45] Date of Patent: Jul. 2, 1985

[54] COOLING FLOW CONTROL DEVICE FOR TURBINE BLADES

[75] Inventor: Richard B. Hook, Burnt Hills, N.Y.

[73] Assignee: General Electric Co., Schenectady, N.Y.

[21] Appl. No.: 479,694

[22] Filed: Mar. 28, 1983

[51] Int. Cl.[3] ..... F01D 5/18

[52] U.S. Cl. ..... 416/96 A; 416/97 R; 415/115

[58] Field of Search ..... 416/90 R, 91, 96 R, 416/96 A, 97; 415/115

[56] References Cited

U.S. PATENT DOCUMENTS

| | | | |
|---|---|---|---|
| 2,763,427 | 9/1956 | Lindsey | 415/115 |
| 3,280,907 | 10/1966 | Hoffman | 416/96 A X |
| 3,301,526 | 1/1967 | Chamberlain | 416/97 |
| 3,574,481 | 4/1971 | Pyne | 416/97 R X |
| 3,628,880 | 12/1971 | Smuland et al. | 416/96 A X |
| 3,767,322 | 10/1973 | Durgin et al. | 416/96 A |
| 4,381,173 | 4/1983 | Freling | 416/96 A |
| 4,407,632 | 10/1983 | Liang | 416/97 R |
| 4,437,810 | 3/1984 | Pearce | 415/115 |

FOREIGN PATENT DOCUMENTS

| | | | |
|---|---|---|---|
| 736800 | 9/1955 | United Kingdom | 416/96 A |
| 980572 | 1/1965 | United Kingdom | 416/97 |
| 1304678 | 1/1973 | United Kingdom | 416/96 A |
| 358525 | 1/1973 | U.S.S.R. | 416/96 |
| 754094 | 8/1980 | U.S.S.R. | 416/96 A |

*Primary Examiner*—Everette A. Powell, Jr.
*Attorney, Agent, or Firm*—J. C. Squillaro

[57] ABSTRACT

A flow control body in the aft end of a hollow core of a turbine vane provides localized increased velocity cooling air flow in a wide portion which is otherwise difficult to cool. The flow control body includes lands and grooves with the cooling air being constrained to flow through the grooves and provide localized cooling while conductive heat transfer through the lands to the flow control body provides substantial temperature uniformity along the length of the vane. Turbulence chambers may be formed in the flow control body to further control cooling and the shape or other parameters of the flow control body may be modified to accommodate uneven end-to-end heating of the vane.

13 Claims, 10 Drawing Figures

FIG. 7
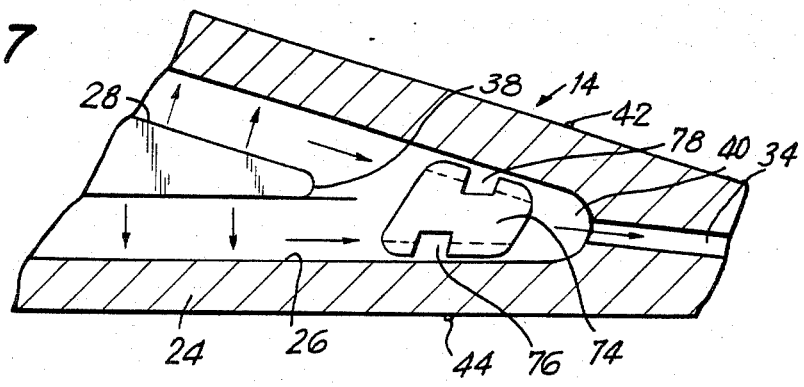
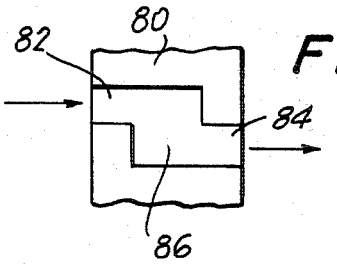
FIG. 8
FIG. 10
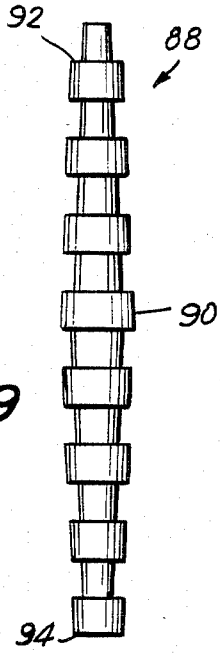
FIG. 9
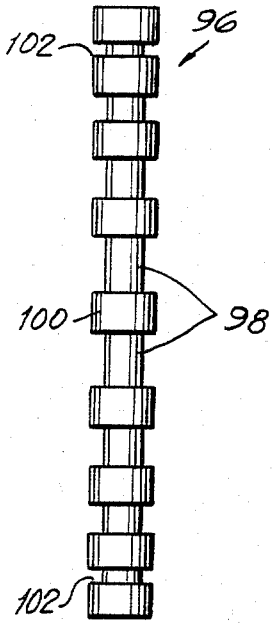

COOLING FLOW CONTROL DEVICE FOR TURBINE BLADES

BACKGROUND OF THE INVENTION

The present invention relates to gas and steam turbines and, more particularly, to apparatus for improving the cooling in vanes or buckets of turbines.

The Carnot efficiency of a heat engine is limited by, along other parameters, the maximum temperature of the working fluid fed to it. Relatively small increases in working fluid temperature can result in substantial efficiency increases. The temperature which is used is limited by the ability of materials in the apparatus to withstand the temperature and continue to function without melting or other forms of destruction. Early attempts to increase the working temperature included the use of metals having superior strength and toughness at elevated temperatures near their melting points. A limit is reached even in so-called super alloys at about twelve to fourteen hundred degrees F. beyond which the material will fail.

Gas and steam turbines represent one type of heat engine in which increasing the working temperature by a relatively small amount results in a relatively large improvement in efficiency. In a gas or a steam turbine, the working fluid (super heated steam or heated air and products of combustion) is directed against blades or buckets of one or more turbine stages to rotate the blades or buckets for delivering power to a shaft. In order to maximize the power derived from the working fluid, it is directed to the first stage turbine through nozzles which are formed between adjacent aerodynamically shaped blades which turn and accelerate the working fluid for impingement on the blades or buckets. Additional nozzles may be employed between subsequent turbine stages to accept the working fluid from the preceding stage, turn, direct and accelerate it for impingement on the next downstream stage. As the working fluid gives up energy to the turbine, it expands and its temperature reduces.

The first one or two stages of vanes forming nozzles thus receive the hottest working fluid and their ability to tolerate high temperatures provides the effective limit to the overall efficiency of the turbine.

One of the techniques employed in the prior art includes active cooling of critical parts employing cooling gas or liquid. For example, U.S. Pat. Nos. 4,244,676; 3,804,551; 4,017,210 and British Pat. No. 641,146 employ cooling flow of liquid or gas in radial passages in turbine blades. U.S. Pat. No. 3,706,508 accomplishes substantially the same result using radial passages in vanes defining turbine nozzles.

A different approach employs coring or hollowing the interior of stator vanes and flowing a cooling gas such as air therein for carrying off the heat. In order to improve the cooling still further, a sheet metal impingement insert may be inserted into the hollow core with holes or other openings directing cooling air at the inner surface of the vane for further improving of cooling. A problem may arise in such cored vanes in the aft end of the hollowed portion. Hot spots may develop on the exterior due to the fact that the cored portion is necessarily quite narrow in this region and it is difficult to properly direct and control cooling air.

OBJECTS AND SUMMARY OF THE INVENTION

Accordingly, it is an object of the invention to provide a cooling apparatus for a nozzle vane or turbine bucket which overcomes the drawbacks of the prior art.

It is a further object of the invention to provide improved cooling in the aft portion of the cored vane or turbine bucket.

It is a further object of the invention to provide a baffle means in the aft end of a turbine bucket which tends to accelerate the air flow past the interior of the vane or bucket for improving cooling in a specific location.

According to a feature of the invention, apparatus is provided for modifying cooling fluid flow in a cored member comprising a hollow core portion defining a wall effective for impinging a cooling fluid against a first inside portion of the wall, a plurality of channels effective to exhaust the cooling fluid from the hollow cored portion, a flow control body interposed between the first inside portion and the channels, and the flow control body including means for modifying a flow of the cooling fluid adjacent a second inside portion of the wall whereby cooling uniformity is enhanced.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 7 is an embodiment of the invention in which the flow control body includes turbulence chambers for positioning points of maximum cooling.

FIG. 8 is a side view of a portion of a flow control body showing a groove having vertically displaced inlet and outlet portions with a turbulence chamber between them.

FIG. 9 is a side view of a flow control body having a tapering shape to more closely fit the tapering shape of a hollow core in a vane.

FIG. 10 is a side view of a flow control body in which at least one parameter is changed from center to end to vary the cooling capability.

DETAILED DESCRIPTION OF THE PREFERRED EMBODIMENT

Although the present invention may be equally useful in stationary vanes and in rotating buckets of a gas or steam turbine, for concreteness of description, a particular embodiment is described adapted for use in a stator vane of a gas turbine engine.

Figure 1:
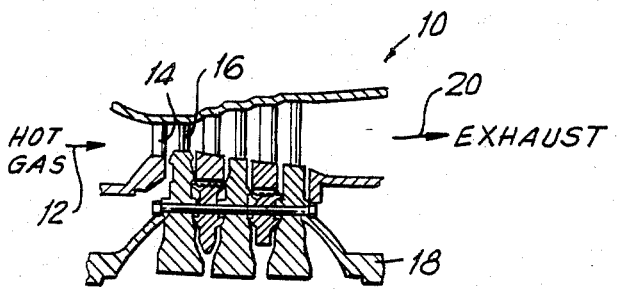
FIG. 1 is a partial cross sectional view of a gas turbine for illustrating the environment in which the present invention is employed.

Referring now to FIG. 1, there is shown, generally at 10, a cross section of a portion of a gas turbine engine. Hot air and products of combustion enter as shown by an arrow 12 passing through an annular set of nozzles formed between a plurality of vanes 14. Vanes 14 turn, direct and accelerate the gas mixture for impingement upon turbine blades or buckets 16 which impart rotary motion to a shaft 18. Subsequent stages of vanes and turbine blades may be employed as is conventional for extracting additional heat from the hot gas and the expanded and cooled gas is exhausted as indicated by an arrow 20.

Figure 2:
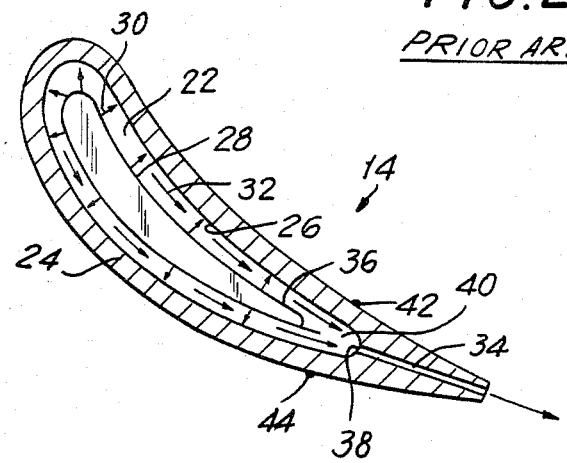
FIG. 2 PRIOR ART
FIG. 2 is a cross sectional view of a cored vane including an impingement insert according to the prior art.

Referring now to FIG. 2, a cross section is shown of a vane 14 according to the prior art. A hollow core 22, preferably formed during casting of vane 14 leaves a relatively thin wall 24 defining the aerodynamic shape of vane 14.

In order to direct cooling air, or other cooling gas, against an inside surface 26 of vane 14, an impingement insert 28 is positioned in hollow core 22 spaced preferably a uniform distance away from inside surface 26. Impingement insert 28 is preferably a closed sheet metal structure into which pressurized cooling air is delivered. A plurality of air delivery holes (not specifically shown in FIG. 2) direct jets of cooling air 30 upon inside surface 26 as indicated by arrows surrounding impingement insert 28. The cooling air in hollow core 22 between impingement insert 28 and inside surface 26 flows toward the trailing edge of vane 14 as indicated by arrows 32. This aft-traveling air cools inside surface 26 and exits through a plurality of trailing edge channels 34.

As indicated in FIG. 2, the aft end of hollow core 22 becomes quite narrow requiring that the aft end 36 of impingement insert 28 also be narrow. In such a narrow portion of impingement insert 28, proper direction of flow of jets 30 is a problem. Aft end 36 is terminated a relatively long distance forward of an entry 38 into trailing edge channels 34. A relatively wide portion 40 at the aft end of hollow core 22 permits the cooling air flowing backward toward trailing edge channels 34 to slow down and thus reduces its cooling capability on wall 24. Studies have indicated that hot spots 42 and 44 may develop in wall 24 in the vicinity of wide portion 40.

Figure 3:
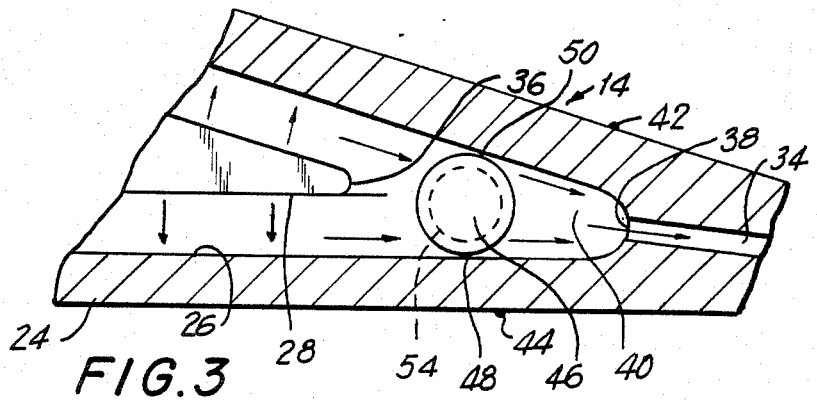
FIG. 3 is a close-up cross sectional view of a portion of a vane including a flow control body according to an embodiment of the present invention.
Figure 4:
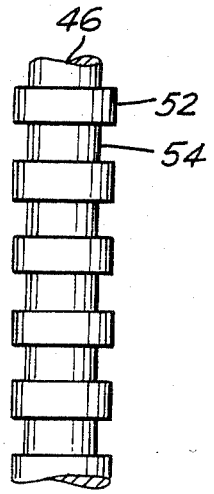
FIG. 4 is a side view of the flow control body of FIG. 3.

Referring now to FIG. 3, a flow control body 46 is disposed in wide portion 40 and contacting inside surface 26 at points 48 and 50. Referring now also to FIG. 4, flow control body 46 may be, for example, a metal rod having a plurality of lands 52 defining between them a plurality of grooves 54. Lands 52 provide the contact at points 48 and 50 with inside surface 26 while cooling air flows in the remaining channels provided by grooves 54. As a result of restricting the flow path in this way, the air flow velocity in the vicinity of inside surface 26 is increased as it passes through grooves 54. The increased velocity enhances local heat transfer so that the temperature at hot spots 42 and 44 is substantially reduced to a temperature approaching that of the remainder of the surface of vane 14. In addition to the enhanced convective cooling due to higher velocity air flow in the vicinity of inside surface 26, flow control body 46 also accepts heat from inside surface 26 at contact points 48 and 50 with lands 52. Flow control body 46 is cooled by the passage of cooling air through grooves 54 and thereby is enabled to discharge the heat gained by conduction to the convective process with the moving air.

The effectiveness of flow control body 46 in enhancing cooling depends on a number of controllable factors which can be varied as necessary to achieve the desired cooling effect. For example, it would be clear that the ratio of land 52 to groove 54 together with the depth of groove 54 determines the air velocity flow through groove 54 and consequently the local cooling by convection. It follows, of course, that as the land to groove ratio increases, the amount of heat absorbed by flow control body 46 by conduction increases. When carried to its extreme, with very wide lands 52 and very narrow grooves 54, convective cooling is excessively localized and the less efficient conductive process through the material of flow control body 46 is incapable of adequately compensating. Thus, an upper limit on the land to groove ratio is definable for any particular application by one skilled in the art in view of the teaching of the present invention.

Flow control body 46 of FIGS. 3 and 4 represents a relatively simple and easily manufactured shape which provides an effective improvement in surface cooling. That is, flow control body 46 may be formed from a simple metallic rod of any suitable metal and grooves 54 may be machined as annular grooves.

Figure 5:
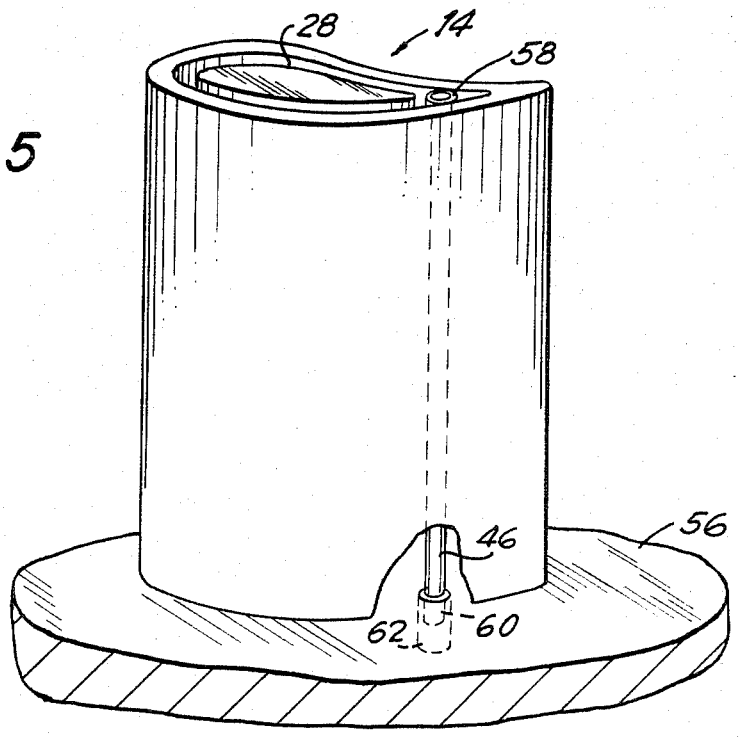
FIG. 5 is a perspective view partially cut away of a vane including a flow control body of FIGS. 3 and 4.

Referring now to FIG. 5, flow control body 46 is seen in perspective in its position in vane 14. For purposes of illustration, vane 14 is shown affixed to a base 56 which may be, for example, an inner or an outer ring (not shown) of a turbine diaphragm. Although a number of different means may be provided for affixing flow control body 46 in vane 14, in the preferred embodiment, one end 58 of flow control body 46 is welded or otherwise rigidly affixed to vane 14 and the other end 60 is slideably inserted in a hole 62 in base 56. The ability of end 60 to displace lengthwise in hole 62 accommodates differential thermal expansion of flow control body 46 and vane 14.

Referring momentarily to FIG. 3, it will be noted that hot spots 42 and 44 are not disposed opposite to each other, but instead, hot spot 42 is disposed substantially downstream of hot spot 44. Thus, localized cooling provided by flow control body 46 may not be optimally located for relieving both hot spots.

Figure 6:
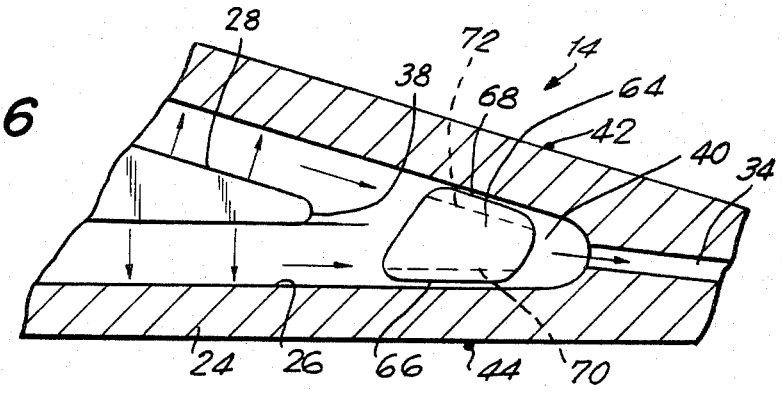
FIG. 6 is a cross sectional view of a portion of a vane including a flow control body which improves the positioning of local cooling with respect to hot spots.

Referring now to FIG. 6, a non-cylindrical flow control body 64 is shown having a generally trapezoidal cross section with lands on a first side 66 contacting inside surface 26 adjacent hot spot 44 and lands of a second side 68 contacting inside surface 26 adjacent hot spot 42. Grooves indicated by dashed lines 70 and 72 in flow control body 64 perform substantially as in the previously described embodiment and will not be further detailed herein. Although the more complex shape of flow control body 64 implies more complex manufacturing processes, such as, for example, casting rather than simpler machining, the improved precision in locating the localized cooling may warrant the extra cost of this approach. In addition, the relatively large area of contact between the land and inside surface 26 may improve conductive heat transfer as compared to the essentially line contact with a cylindrical flow control body as shown in FIGS. 3 and 4.

Referring now to FIG. 7, a flow control body 74 is shown in which a turbulence chamber 76 and 78 is disposed in each side adjacent inside surface 26. This breaks up grooves in each side so that the cooling air passes through a first half groove and into it respective turbulence chamber wherein the increased depth of the turbulence chamber causes mixing and disturbance of the air flow for enhanced cooling after which the air passes through a remaining portion of the groove before exiting through trailing edge channels 34. The embodiment of the invention in FIG. 7 implies that turbulence chambers 76 and 78 be formed as straight vertical grooves in the surfaces of flow control body 74. This is not the only possibility as indicated by an embodiment in FIG. 8. A flow control body 80 has inlet grooves 82 vertically displaced from outlet grooves 84. Inlet and outlet grooves 82 and 84 are joined by a turbulence chamber 86.

Vane 14 is formed by precision investment casting using a pair of cores in a mold to form hollow core 22 with each core extending in from the end and abutting the opposed core. In order to permit mold release, a draft or slight convergent shape is given to the cores. Thus, hollow core 22 converges slightly from its outer ends toward its center. An embodiment of the invention in FIG. 9 accommodates this shape by modifying the diameter of a flow control body 88 into a slightly spindled shape with a maximum diameter land 90 in the center and smaller diameter lands 92 and 94 at the ends. This permits satisfactory contact of the lands with inside surface 26 of vane 14 to improve conductive heat transfer.

In a typical turbine application, the temperature of a vane varies from end to end due to the flow characteristics of the hot gas or steam being directed. Typically, the center of a vane is hotter than its ends.

Referring now to FIG. 10, a flow control body 96 is shown in which the land to groove ratio is varied from the center to the ends to achieve more uniform cooling. Without intending limitation in any way, center grooves 98 surrounding a center land 100 are wider than end grooves 102 with groove widths narrowing progressively from center to end. It will be noted that land widths in flow control body 96 are constant throughout the length and the variation is provided by changing the groove widths. A similar affect may be provided by employing a constant groove width and varying land width. Alternatively, both land and groove widths may be modulated as necessary. Besides these width variations, groove depths may be varied from center to end. That is, center grooves 98 may be made shallower so that the flow velocity is greater in the vicinity of inside surface 26 than at the ends where the grooves are made deeper. Other alternatives would occur to one skilled in the art in view of the teaching herein.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. Apparatus for modifying cooling fluid flow comprising:

a turbine vane;

an external surface on said turbine vane exposed to a gas flow at an elevated gas temperature;

said turbine vane including a leading edge and a trailing edge;

a hollow cored portion of said turbine vane defining a wall;

an impingement insert in said hollow cored portion effective for impinging a cooling fluid against a first inside portion of said wall;

a plurality of channels in said trailing edge effective to exhaust said cooling fluid from said hollow cored portion;

an end of said impingement insert being spaced upstream from said plurality of channels thereby leaving a wide portion in said hollow cored portion upstream of said plurality of channels and downstream of said impingement insert;

a flow control body in said wide portion interposed between said end of said impingement insert and said channels; and said flow control body including a plurality of grooves therein defining a plurality of lands therebetween, said grooves being disposed generally in a direction of flow of said cooling fluid, said lands contacting an inside surface of said hollow cored portion in said wide portion and being effective for absorbing heat therefrom, said grooves having depths and a ratio to said lands effective to accelerate a flow of said cooling fluid adjacent said inside surface for cooling said inside surface in said wide portion and said flow control body whereby cooling uniformity of said turbine vane in a vicinity of said wide portion is enhanced.

2. Apparatus according to claim 1, wherein said flow control body is a generally clyindrical rod.

3. Apparatus according to claim 1, wherein said flow control body is a generally spindle rod including angles of a surface of said lands effective to maintain contact with said wall along its length.

4. Apparatus according to claim 1, wherein said lands define first and second opposed surfaces, said first and second opposed surfaces contacting said wall, one of said first and second opposed surfaces being disposed upstream of the other thereof whereby modification of said flow is differently positioned in a flow direction.

5. Apparatus according to claim 1, wherein said flow control body further includes means for producing a localized turbulence adjacent said inside wall.

6. Apparatus acccording to claim 5, wherein said flow control body includes a rod, and said means for producing localized turbulence including a discontinuity in said grooves.

7. Apparatus according to claim 6, wherein said discontinuity includes an increase in said depths.

8. Apparatus according to claim 6, wherein, said discontinuity includes a turbulence chanber in said grooves.

9. Apparatus according to claim 8, wherein said turbulence chamber includes an increase in said depths.

10. Apparatus according to claim 8, wherein said turbulence chamber includes at least one change in direction of said grooves.

11. Apparatus according to claim 8, wherein said grooves include an entry portion and an exit portion, said entry and exit portions being displaced from each other with respect to a flow direction of said cooling fluid, said turbulence chamber including a portion of said groove joining said entry and exit portions.

12. Apparatus according to claim 1, wherein said flow control body includes a rod and at least one of a land lengths, a groove lengths and said groove depths being varied along a length of said rod in a pattern effective to modify said heat transfer along said length of said rod.

13. Apparatus according to claim 12 wherein said groove lengths are varied and said groove depths and land lengths are uniform.

* * * * *